US010661928B2

(12) United States Patent
Hogue et al.

(10) Patent No.: US 10,661,928 B2
(45) Date of Patent: May 26, 2020

(54) STACKING AND STRAPPING SYSTEM FOR MATERIAL PACKAGES

(71) Applicant: Hogue Industries, LLC, West Linn, OR (US)

(72) Inventors: Gary Wayne Hogue, West Linn, OR (US); Brian Cornelius Hogue, West Linn, OR (US)

(73) Assignee: Hogue Industries, LLC, West Linn, OR (US)

( * ) Notice: Subject to any disclaimer, the term of this patent is extended or adjusted under 35 U.S.C. 154(b) by 352 days.

(21) Appl. No.: 15/643,563

(22) Filed: Jul. 7, 2017

(65) Prior Publication Data

US 2018/0022491 A1 Jan. 25, 2018

Related U.S. Application Data

(60) Provisional application No. 62/493,989, filed on Jul. 25, 2016.

(51) Int. Cl.
*B65B 13/18* (2006.01)
*B65B 13/20* (2006.01)
(Continued)

(52) U.S. Cl.
CPC ..... *B65B 35/50* (2013.01); *B65B 13/181* (2013.01); *B65B 13/184* (2013.01); *B65B 13/20* (2013.01); *B65B 27/10* (2013.01); *B65B 57/14* (2013.01)

(58) Field of Classification Search
CPC ..... B65B 13/181; B65B 13/20; B65B 13/184; B65B 27/10; B65B 57/14; B65B 35/50;
(Continued)

(56) References Cited

U.S. PATENT DOCUMENTS 2,664,813 A * 1/1954 Rose ..... B65B 27/10 100/25
2,947,125 A * 8/1960 Wilson ..... B65B 35/50 53/495

(Continued)

OTHER PUBLICATIONS

BPX Signode Lumber and Panel Strapping Machine product brochure, Signode Industrial Group, May 24, 2016.

(Continued)

*Primary Examiner* — Jimmy T Nguyen
(74) *Attorney, Agent, or Firm* — Craig R. Rogers; Simple IP Law, P.C.

(57) ABSTRACT

A lumber stacking and strapping system can provide a single-station solution for both lumber stacking and package strapping. In addition, the package strapping system may apply multiple straps simultaneously to the package. For example, a package stacking and strapping system can provide not only a mechanism for formulating a package of lumber one layer at a time, but also a mechanism for lowering a completed package directly into a compression and strapping station, such as using the lumber stacker package accumulation hoist. The stacking and strapping system can then simultaneously apply strapping around the package in multiple positions along the length of the package, with bottom battens and top corner protectors further supplied and strapped into place as desired. A method for stacking and strapping a package in a single location is also provided.

20 Claims, 19 Drawing Sheets

(51) Int. Cl.
*B65B 35/50* (2006.01)
*B65B 57/14* (2006.01)
*B65B 27/10* (2006.01)

(58) Field of Classification Search
CPC ..... B65B 27/02; B65B 27/08; B65B 27/105; B65B 27/12; B65B 27/125; B65D 77/04
USPC ..... 100/2, 3
See application file for complete search history.

(56) References Cited

U.S. PATENT DOCUMENTS 3,039,593 A * 6/1962 Edmonds ..... B65B 35/50 198/374
3,343,689 A * 9/1967 Fehely ..... B65B 27/10 414/789.5
3,427,959 A * 2/1969 Keil ..... B65B 27/10 100/212
3,783,773 A * 1/1974 Willard ..... B65B 27/12 100/7
3,871,288 A * 3/1975 White ..... B65B 27/10 100/2
4,829,750 A * 5/1989 Cassidy ..... B65B 13/022 53/390
5,289,668 A * 3/1994 Meyer ..... B65B 13/181 53/139.7
7,428,865 B1 * 9/2008 Kasel ..... B65B 13/04 100/26
2014/0150383 A1 * 6/2014 Okamoto ..... B65B 27/08 53/589

OTHER PUBLICATIONS

Samuel Strapping Systems SLP-25 Compression Strapping Machine product brochure, Samuel Strapping Systems, undated.
Mailis Baling Industry product website, http://www.maillis.com/applications/baling/#prettyPhoto, 2013.
Baling Fibers video, https://www.youtube.com/watch?time_continue=7&v=rCzWX0IZRus, Jul. 25, 2013.

* cited by examiner

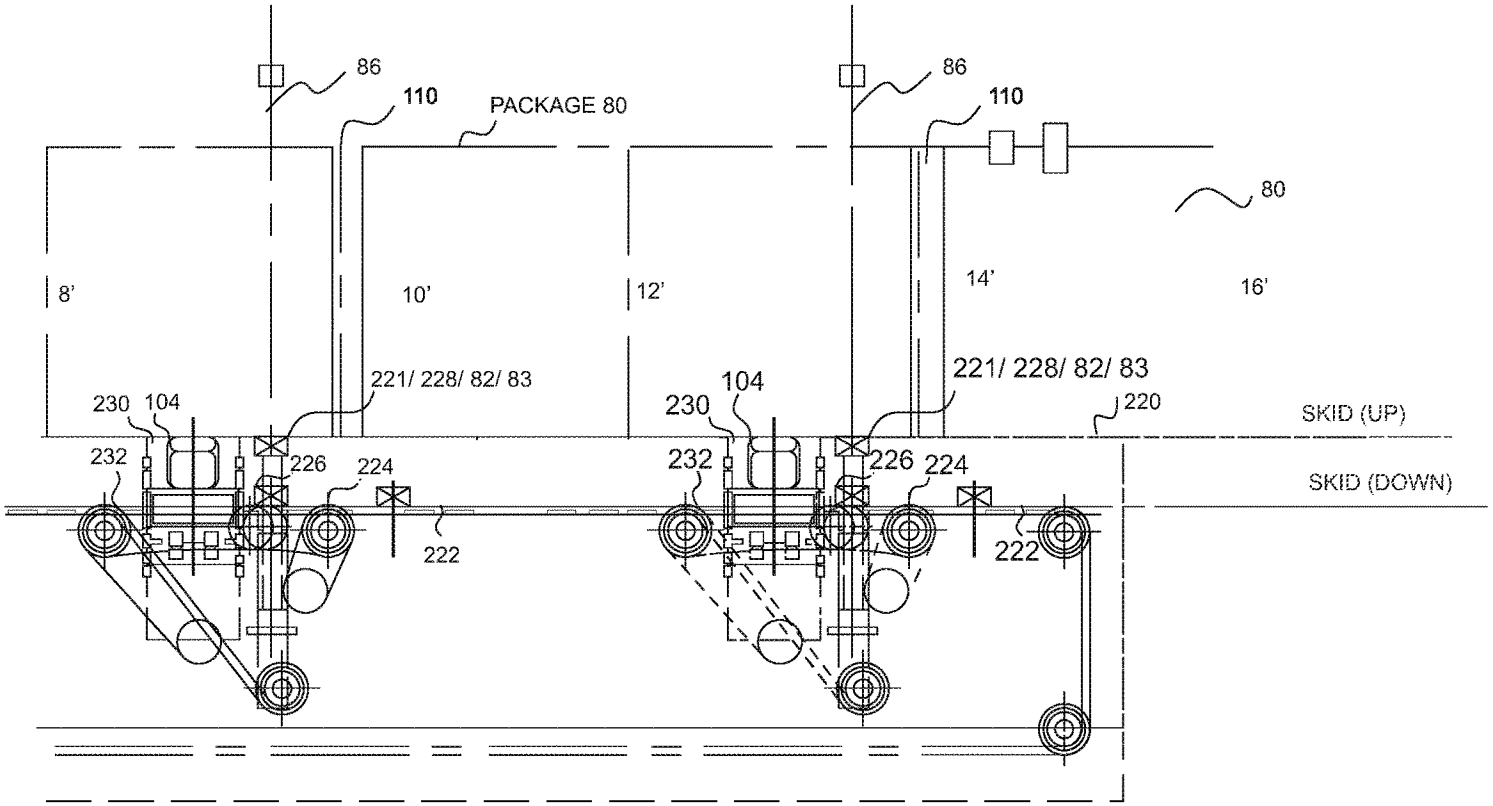
FIG. 12A (enlarged section view)

STACKING AND STRAPPING SYSTEM FOR MATERIAL PACKAGES

PRIORITY CLAIM

This application is a non-provisional of, and claims priority from, U.S. Provisional Patent Application Ser. No. 62/493,989, filed Jul. 25, 2016, the contents of which are hereby incorporated herein by reference in their entirety.

BACKGROUND OF THE INVENTION

Field of the Invention

This invention relates generally to material stackers and strapping systems. More particularly, this invention relates to a stacking, packaging, and strapping system for lumber or other material that provides a number of advancements over the prior art.

Related Art

Conventional lumber mills do not have an effective or efficient means for strapping packages accumulated by a lumber stacker. Conventional package strappers are often located in a separate area of the lumber mill, remotely located from the lumber stacker. Conventional package strappers also generally apply only one strap at a time (i.e., at a single position along the length of the package), and therefore require multiple strapping operations to apply multiple straps along the length of the package. High-speed lumber stackers can produce more packages of lumber than the current single position, remotely located strappers are able to effectively accommodate.

More specifically, packages accumulated in the lumber stackers are typically transferred from the stacker to a remote strapper location where they are then strapped together with multiple (e.g., 2, 3, 4, or more) straps, one strap at a time. Unfortunately, not only does this result in inefficiencies in terms of time and floor space requirements, but it may also result in lumber packages falling apart during transport. This can create health and safety issues in addition to the hassle and expense of downtime resulting from having to restack the lumber into packages. And the single position strappers are themselves inefficient and require multiple operations to apply straps at various locations along a single package to effectively hold the package together for transportation.

Some conventional lumber packages may have a containment ring or hoop applied at the stacker. However, if a containment "hoop" is applied at all, it is normally a manually-applied, single hoop arranged in a position located near only one end of the package. For instance, a single containment hoop may be arranged at the 2' or 3' position on an 8' to 16' long load. While offering slight improvement over a completely unsecured package, the containment hoop solution does not sufficiently secure the package and such packages must be transported at a much slower speed than desirable to accommodate the precarious nature of the loosely bundled package. Numerous improvements are needed to provide an efficient and dependable strapping solution for a lumber mill.

SUMMARY OF THE INVENTION

According to various embodiments and principles of the present inventive concepts, a lumber stacking and strapping system can provide numerous improvements over the prior art, including, for instance, providing a single station solution for both lumber stacking and package strapping. In addition, the package strapping system may apply multiple straps simultaneously to the package. Inefficiencies in operation can be significantly reduced using these and additional principles of the present inventive concepts.

According to certain aspects of the present inventive concepts, a package stacking and strapping system can provide not only a mechanism for formulating a package of lumber one layer at a time, but also a mechanism for lowering a completed package directly into a compression and strapping station using the lumber stacker package accumulation hoist. The stacking and strapping system can then simultaneously apply strapping around the package in multiple positions along the length of the package, with bottom battens and top corner protectors further supplied and strapped into place as desired.

A single-station packaging and strapping system provides a solution to the problem within lumber mills of having high-speed stackers that produce more packages of lumber to be strapped than the conventional single position, remotely located strappers are able to accommodate. It also solves problems associated with loosely stacked packages of lumber falling apart while being transported to the remote strappers and eliminates the need for packages to be contained and/or held together by some other means (such as inefficient containment hoops).

Without the solution of the present inventive concepts, if the package does disintegrate on the lumber stacker hoist or thereafter (such as during transport to the strapper), it can result in significant downtime due to having to manually restack the package. A disintegrated package further poses a significant safety risk including a threat of physical injury to the operator(s).

Further benefits are also achievable using the principles disclosed herein. According to one aspect of the present inventive concepts, a set of containment or compression arms may be arranged near a back side of the package being formulated and may be configured to side compress the package during and after it is completed. This can be accomplished, for instance, using a pneumatic, electric, or hydraulic ram that may be positioned at any desired horizontal position to accommodate various package widths (i.e., an "infinitely positionable" ram assembly), a position detecting device, multiple package side compression arms, and electronic controls. Maintaining a tightly compressed package allows for a consistent reference point for further processing with bunk applicators, corner protectors, and strapping.

According to an embodiment of the present inventive concepts, the stacking and strapping system may include package side compression arms that can be located at any position along the package length and/or that may be adjusted to accommodate any package width. It may further include a strapping system that can apply straps at any desired position along the package length (i.e., an "infinitely positionable" strapping system) or at multiple preset or adjustable positions. An "infinitely positionable" strapping system (or at least one having multiple preset and/or adjustable strapping positions) is desirable because the bottom bunk and strap positions should be symmetrical to allow for stacking the finished package units on top of each other for storage and/or transportation.

The straps may, for instance, be conventional plastic straps as used by conventional strappers. Alternatively, the straps may be stretch wrap (i.e., strips of package wrap), tie wraps (such as zip-ties, twist-ties, or the like), or any other wraps, ties, straps or similar devices capable of securing the package together in a tight bundle.

Principles of the present inventive concepts provide the ability to properly compress packages of various widths, as well as the ability to then apply straps at various positions along the package length in order to hold the package together in a tight formation and to permit the packages to be stacked one on top of the other in a stable fashion for further handling and shipping. These principles further provide for the simultaneous application of multiple straps to further increase efficiencies of operation.

According to a further embodiment of the present inventive concepts, in addition to formulating the package, the package accumulation arms may also be used to compress the top of the package during the strapping process. This ability can further enable a tightly assembled package for further handling and shipping. Of course, other methods or mechanisms may also, or alternatively, be used to perform the top compression function.

According to one embodiment, a lumber stacker primary accumulation lift is designed to retract, index up, extend out, and travel up in order to retrieve layers of lumber as they are being stacked by the lumber stacking arms, or to intercept a full or partial package of lumber from the secondary lift, as it is being formulated. Once the primary accumulation lift has a full package, it lowers the package directly into position in the strapper, where multiple straps can be attached to the package at desired locations. Packages of lumber generally require two straps for 6', 8', 10', and 12' package lengths, and three straps for 14', and 16' package lengths. Longer package lengths may require even more straps.

In addition to the forgoing benefits, many mills may desire bottom battens (or bunks) to be strapped to each finished package to accommodate fork lift handling, shipping, stacking, storage, and the like. According to further embodiments of the present inventive concepts, therefore, a package stacking and strapping system may further allow for the bottom battens to be inserted onto the package accumulation arms, or onto trays alongside of the accumulation arms, for instance, before strapping the package. The bunks can therefore be arranged in place before the package accumulation arms travel up to retrieve or assemble a newly formed package, and can then be strapped to the assembled package by the strapper. Of course, consistent with the inventive principles, the bunks could be inserted in numerous other ways, or at any of a variety of stages, within the packaging and strapping process.

According to still further embodiments, the outfeed transfer conveyor may be designed with flites positioned for the battens/bunks such that the package accumulation arms can fit in-between the flutes. This design can accommodate the strapping of the package with or without bottom bunks, and further allows the primary lift arms to retract to permit the lengthwise discharge of the strapped package. Of course, there are many other ways the conveyor could be designed consistent with the inventive concepts, such as with lift skids arranged to hold the package up so the primary arms could retract and allow clearance for the battens/bunks, and the like.

The package accumulation lift arms may also be designed to retract from the outfeed conveyor to be returned to the partially up and extended positions and to then be lowered over the package to compress the top of the lumber package as it is being strapped. The lift arms can thereafter travel to receive the bunks and then travel up for the retrieval of the next set of partial layers or a full package of lumber.

The strapping system can be designed to apply the straps in any desirable manner. Various embodiments for providing the strapping material will be described herein, but the inventive concepts are not limited thereto. One method for applying the straps can include, for instance, using extending and retracting strapping tracks located at the top and bottom of the finished package, arranged at multiple locations.

Other ways may include gripping systems built into the retracting and extending package accumulation arms that are configured to retrieve strapping material from a strapping head device, wind strapping material around the package at multiple locations at the same time, and then feed the strapping material back into the strapping head for cinching, sealing, and cutting.

A primary inventive concept is the ability to strap the package at the same mill location in which it has been accumulated, such as by having the package of lumber descend directly into the strapping area for immediate strapping. Benefits of the inventive concepts includes a significant reduction in strapping time, as well as eliminating complex transportation and control systems for routing packages to remote, standalone strapping stations, along with a large reduction in floor space requirements.

Various principles of these inventive concepts may therefore include, for instance, the marriage of the stacking, package accumulation, package compression, and package strapping functions all in one location. These principles may also include application of multiple straps simultaneously. This provides significant improvements over having separate stacking and strapping locations with the associated complex package transfer schemes to facilitate package transport between the separate locations, and over having strappers capable of applying only a single strap at a time.

According to further embodiments of the present inventive concepts, a unique electronic control system may also be provided. According to one embodiment, for example, a single electronic control station can control both the stacking and the strapping operations. Accordingly, the controls for the typically separate stacking and strapping functions, with typically separate standalone controllers, can instead be integrated into one controller at a single location, thereby further reducing components and expense.

For instance, the present inventive concepts allow for a consolidated controls system without the necessity of tracking packages being transported from the stacker hoist to the remote strapping area for the application of package identification and inventory tickets. Using these concepts, the application of ID's can be done at the strapped package outfeed conveyor at the stacker, providing significant programming and control savings. In addition, the particularly difficult problems associated with spilled and re-entered packages between the stacker and the strapping/package ID system can be eliminated.

Various aspects, embodiments, and configurations of these inventive concepts are possible without departing from the principles disclosed herein. The present invention is therefore not limited to any of the particular aspects, embodiments, or configurations described herein but should be interpreted as encompassing all designs and modifications thereof capable of providing intended benefits consistent with the appended claims.

BRIEF DESCRIPTION OF DRAWINGS

The foregoing and additional objects, features, and advantages of the present inventive concepts will become more readily apparent from the following detailed description of preferred embodiments, made with reference to the accompanying drawings, in which:

FIGS. 1 through 6 provide various illustrations of a package accumulation and strapping system according to one embodiment of the present inventive concepts to illustrate an operation for accumulating and strapping a package at a single station, wherein:

FIG. 1 is a somewhat schematic side elevation view of a combination package accumulation and strapping system in a first operating position according to one embodiment of the present inventive concepts;

FIG. 2 is a somewhat schematic side elevation view of package accumulation and strapping system of FIG. 1 in a second operating position;

FIG. 3 is a somewhat schematic side elevation view of package accumulation and strapping system of FIG. 1 in a third operating position;

FIG. 4 is a somewhat schematic side elevation view of package accumulation and strapping system of FIG. 1 in a fourth operating position;

FIG. 5 is a somewhat schematic side elevation view of package accumulation and strapping system of FIG. 1 in a fifth operating position; and FIG. 6 is a somewhat schematic side elevation view of package accumulation and strapping system of FIG. 1 in a sixth operating position.

FIGS. 1A through 6A provide various illustrations of a package accumulation and strapping system according to another embodiment of the present inventive concepts to illustrate an operation for accumulating and strapping a package at a single station, wherein:

FIG. 1A is a somewhat schematic side elevation view of a combination package accumulation and strapping system in a first operating position according to another embodiment of the present inventive concepts;

FIG. 6A is a somewhat schematic side elevation view of package accumulation and strapping system of FIG. 1A in a sixth operating position.

FIGS. 9 through 12 provide various illustrations of a package accumulation and strapping system to illustrate an operating sequence for positioning battens below an accumulated package (or a package to be accumulated) in the package accumulation and strapping system, wherein:

FIG. 9 is a somewhat schematic top elevation view of a package accumulation and strapping system in a first operating position, illustrating an operation for positioning battens below an accumulated package according to a still further aspect of the present inventive concepts;

FIG. 10 is a somewhat schematic top elevation view of the package accumulation and strapping system of FIG. 9 in a second operating position;

FIG. 11 is a somewhat schematic front elevation view of one of the batten positioning systems of FIG. 10, illustrating a third operating position;

FIG. 12 is a somewhat schematic front elevation view of the package accumulation and strapping system of FIG. 9, illustrating a fourth operating position; and FIG. 12A is an enlarged view of a portion of the package accumulation and strapping system of FIG. 12.

DETAILED DESCRIPTION OF ILLUSTRATIVE EMBODIMENTS

Figure 1:
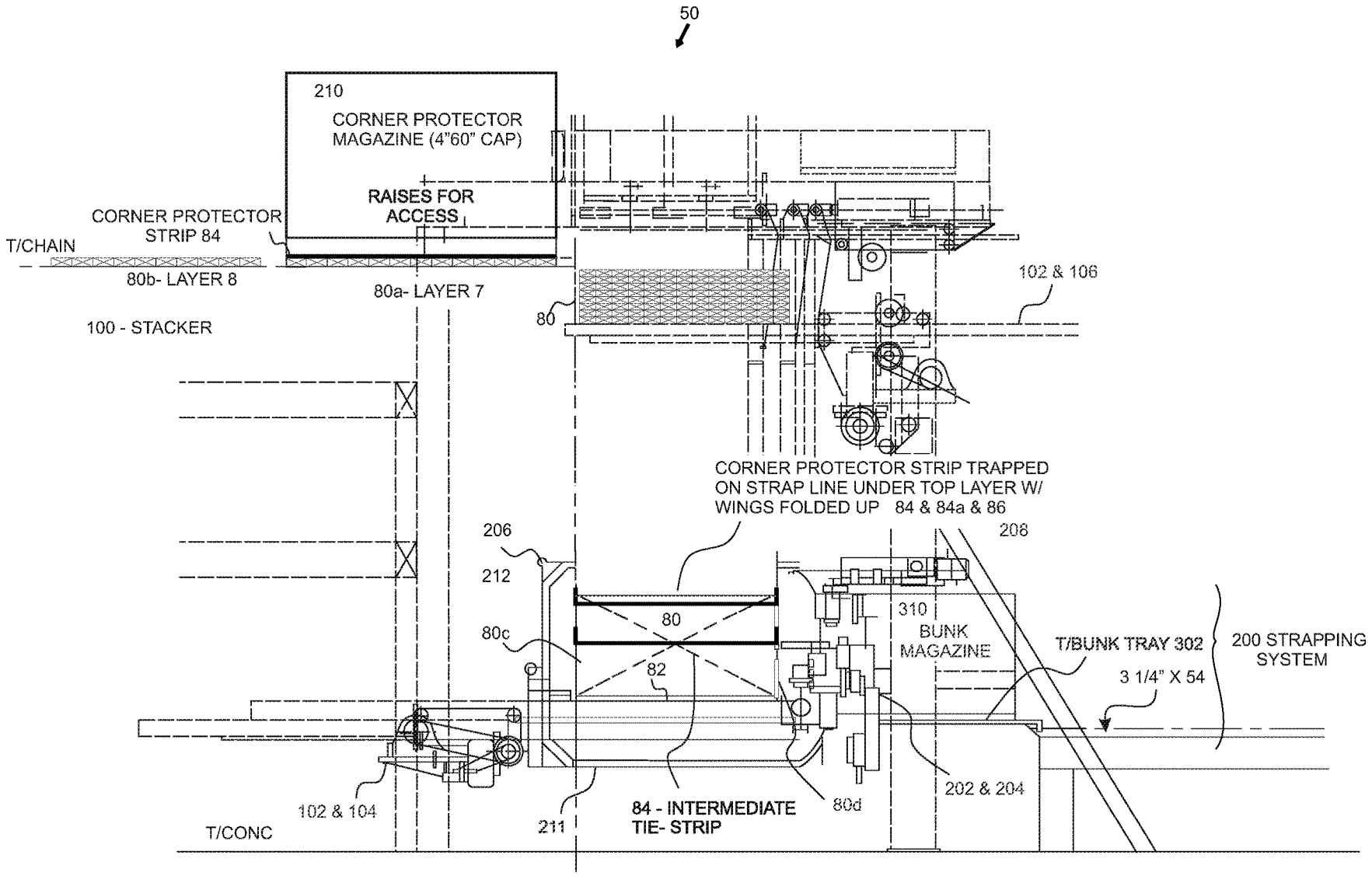
Figure 1A:
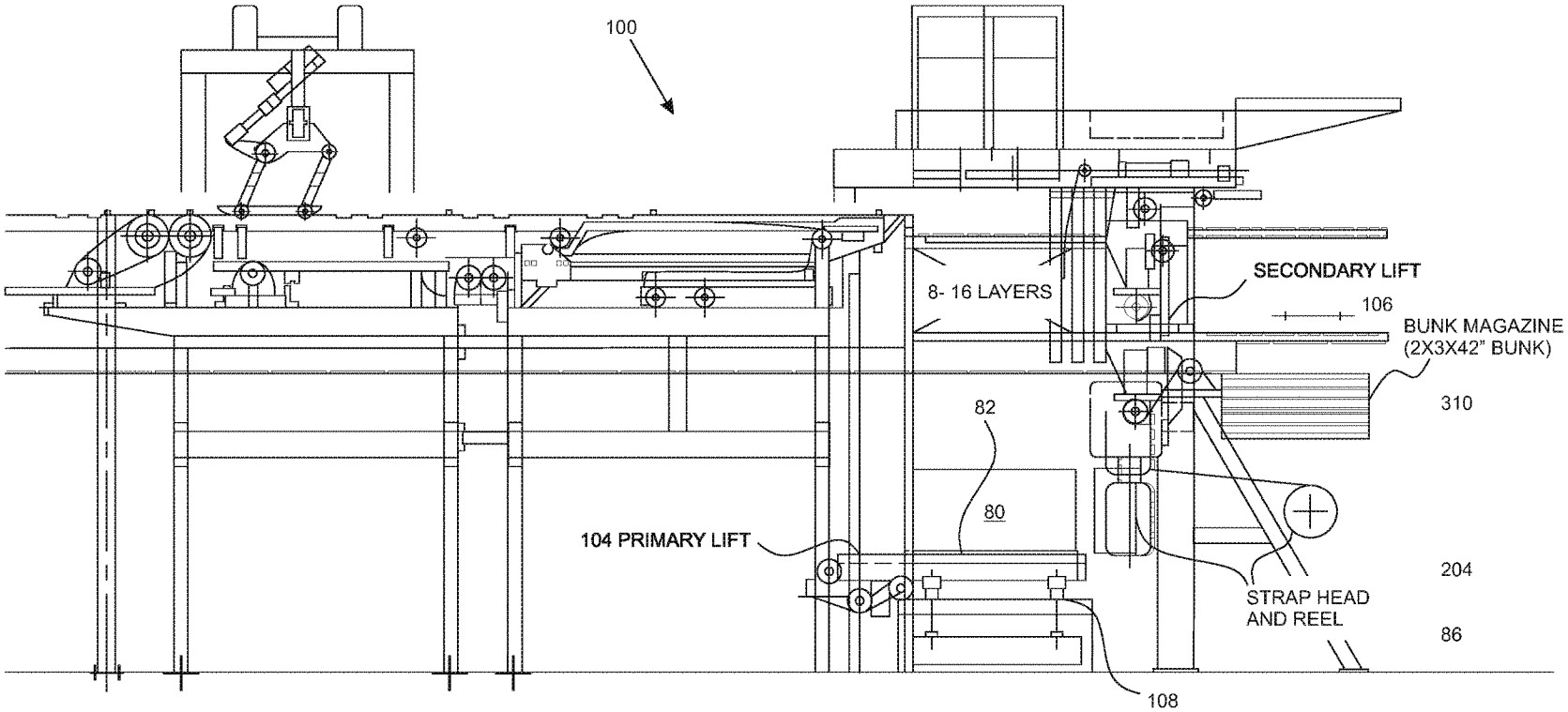

Various features, benefits, and configurations incorporating the principles of the present inventive concepts in illustrative embodiments are shown and described in detail in the accompanying documents and drawings, the contents of which are incorporated by reference in their entirety. Additional features, benefits and configurations will be readily apparent to those of ordinary skill in the art based on this disclosure and all such features, benefits and configurations are considered within the scope of the present invention. Various illustrative embodiments will now be described in connection with the accompanying drawings.

FIGS. 1 through 6 and 9 through 12 illustrate a process for accumulating and strapping a package at a single station using a package accumulation and strapping system 50 according to one embodiment of the present inventive concepts. Referring to FIGS. 1 through 6 and 9 through 12, according to principles of the present inventive concepts, a package 80 is accumulated at an accumulation hoist 102 (including a secondary lift 106) located at an output end of a material stacker 100. Without being moved to another station, the accumulated package 80 can be lowered onto battens 82 in a strapping system 200 and strapped at multiple locations along the length of the package 80 to secure the package 80.

This single-station process for formulating (accumulating) and strapping a package of lumber (or other material) can further provide both top corner protectors 84 aligned under the strap 86 and a batten 82 aligned and attached to the bottom of the package 80. The package 80 can therefore be secured together in a way that transportation of the package 80 from the package accumulator (stacker) 100 can be accomplished without risk of package separation or disintegration.

According to principles of the inventive concepts, multiple straps 86 can be simultaneously attached to the package 80 at multiple desired locations. Where bunks/battens 82 are provided, the multiple strap locations preferably correspond to the locations of the bunks/battens 82. Multiple strappers (with strap reels, strapping heads, and bunk applicators, for instance) 202 may be provided to simultaneously strap the package 80 at the multiple locations.

Packages of lumber, for instance, generally require two straps for 6', 8', 10', and 12' package lengths, and three straps for 14', and 16' package lengths. Longer package lengths may require even more straps, and additional straps could also be applied to shorter packages. The desired locations for the straps (and therefore the strappers) may vary depending on the length of the package.

For instance, for an 8' package, straps may be applied at the 2' and 6' locations. For a 10' package, straps may be applied at the 2' and 8' locations. For a 12' package, straps may be applied at the 2' and 10' locations. For a 14' package, straps may be applied at the 2', 7', and 12' locations. And for a 16' package, straps may be applied at the 2', 8', and 14' locations.

To provide straps at these various locations, multiple strappers 202 can be provided and can have either a fixed or an adjustable position. For example, a first strapper 202*a* can be arranged at the 2' location and can have a fixed, first position since this strapping location remains the same for all package lengths. The first strapper 202*a* supplies a first strap 86*a* at the first position. A second strapper 202*b* can be provided to apply a second strap 86*b* at a second location. The second location may, for instance, be the 6', 7', or 8' position depending upon the length of the package 80. The location of the second strapper 202*b* is therefore preferably adjustable between the 6', 7', and 8' locations to apply a strap 86 at the desired second location based upon the package length. A third strapper 202*c* can likewise be provided and can be adjustable between the 10', 12', and 14' locations to provide a third strap 86*c* at an appropriate third location (if desired) depending upon the package length. Additional strappers 202*d* for providing additional straps 86*d* can be provided for packages longer than 16' (or for packages shorter than 16' when additional straps are desired) and can also be configured to be adjustable between various desired positions or arranged in fixed positions. The inventive concepts are, of course, not limited to these specific strapper positions and adjustabilities, and any other combination of strapper positions and adjustabilities is within the scope of the inventive concepts.

Referring now specifically to FIG. 1, as a first step in a package strapping process, once a package 80 has been sufficiently assembled in the lumber stacker 100, a corner protector strip magazine 210 places a corner protector strip (e.g., a 60" long strip) 84 onto a desired package layer, such as the second to last layer 80*a* (e.g., layer 7 of an 8-layer package or layer 15 of a 16-layer package) for a top corner protector strip. The corner protectors are 84 preferably applied at each strap line (i.e., where each strap will be secured). The top or final layer 80*b* (e.g., the $8^{th}$ layer of an 8-layer package or $16^{th}$ layer of a 16-layer package) is then stacked on top of the second to last layer 80*a*, trapping the corner protector strip 84 in place with vertical wings 84*a* of the corner protector strip 84 extending horizontally beyond the sides of the package 80. The corner protector strip magazine 210 is preferably raised when not in use for better operator access to the stacking operation. The corner protector strips 84 may, for example, be 60" long to accommodate 2" and 4" thick lumber. The strips 84 can also be used as intermediate layer tie strips for loose and unstable packages of lower grade 2×4's and the like.

Some systems may be configured to assemble and strap packages without bunks/battens. In addition to the top corner protectors, such systems may further be configured to provide bottom corner protectors. Although not illustrated or described herein, the mechanism and manner for applying the bottom corner protector may be similar to that for applying the top corner protector.

Figure 2:
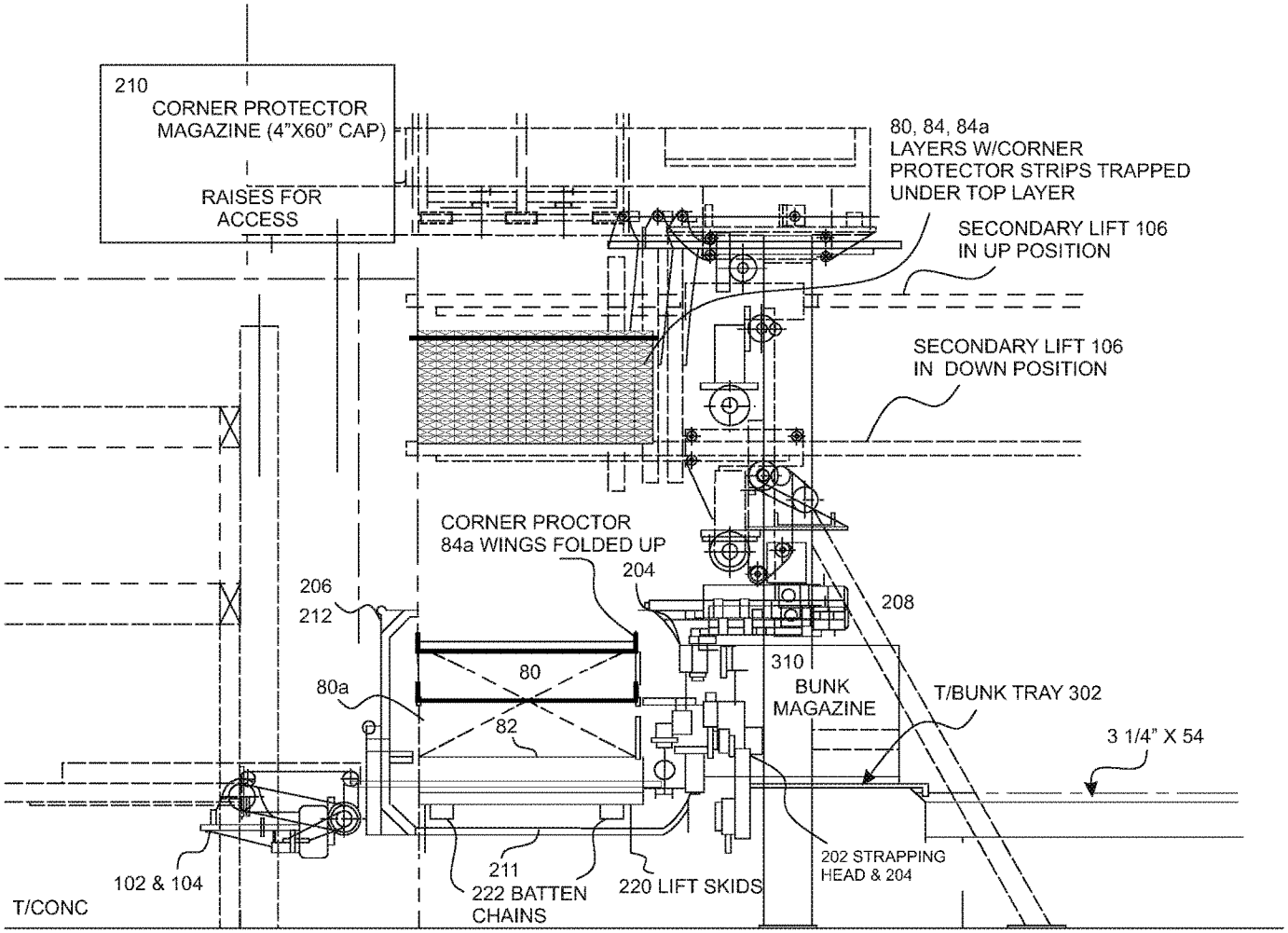
Figure 2A:
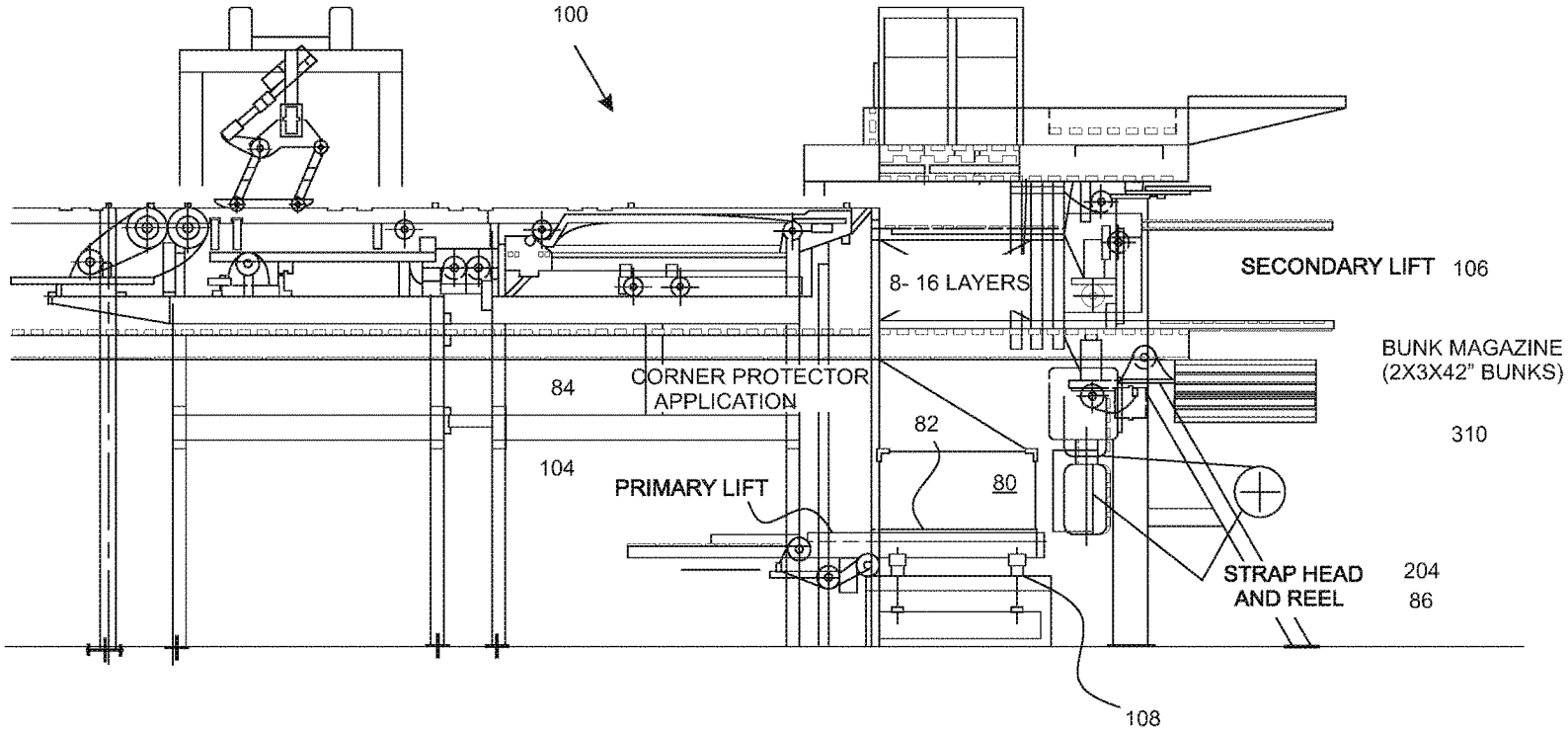
FIG. 2A is a somewhat schematic side elevation view of package accumulation and strapping system of FIG. 1A in a second operating position.

Referring now to FIG. 2, the secondary lift 106 accumulates a desired package size (e.g., 8, 16, or 20 layers) of a desired material (e.g., 2" thick lumber or other material having a desired thickness). The primary lift 104 then retrieves a full or partial package from the secondary lift 106, allowing any partial packages to be completed, and then lowers a full (completed) package 80 onto battens 82 arranged on the raised lift skids 220 with the top strap track 204 retracted. As the package 80 is lowered into position, rails along the sides of the package 80 fold the corner protector strip wings 84*a* from the horizontal to the vertical position. The secondary lift 106 moves back into the up and extended position to begin receiving layers of lumber for a subsequent package while the primary lift 104 lowers the full package 80 onto the battens 82. The bottom bunks/battens 82 are already located in place on the bunk chains 222 or raised lift skids 220, aligned to the strap lines. This can be accomplished, for instance, using a process such as that described later with reference to FIGS. 7 through 12.

Figure 3:
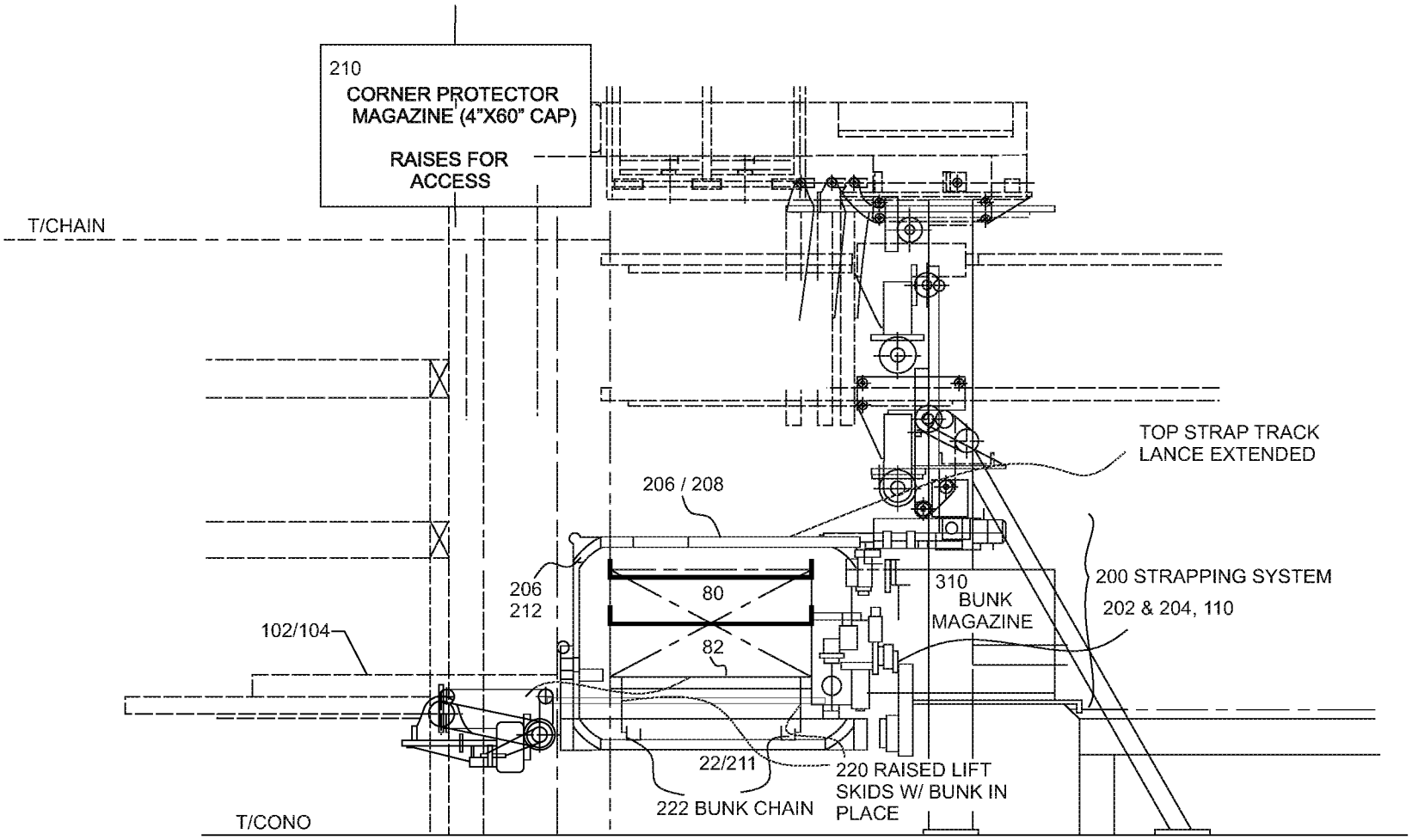
Figure 3A:
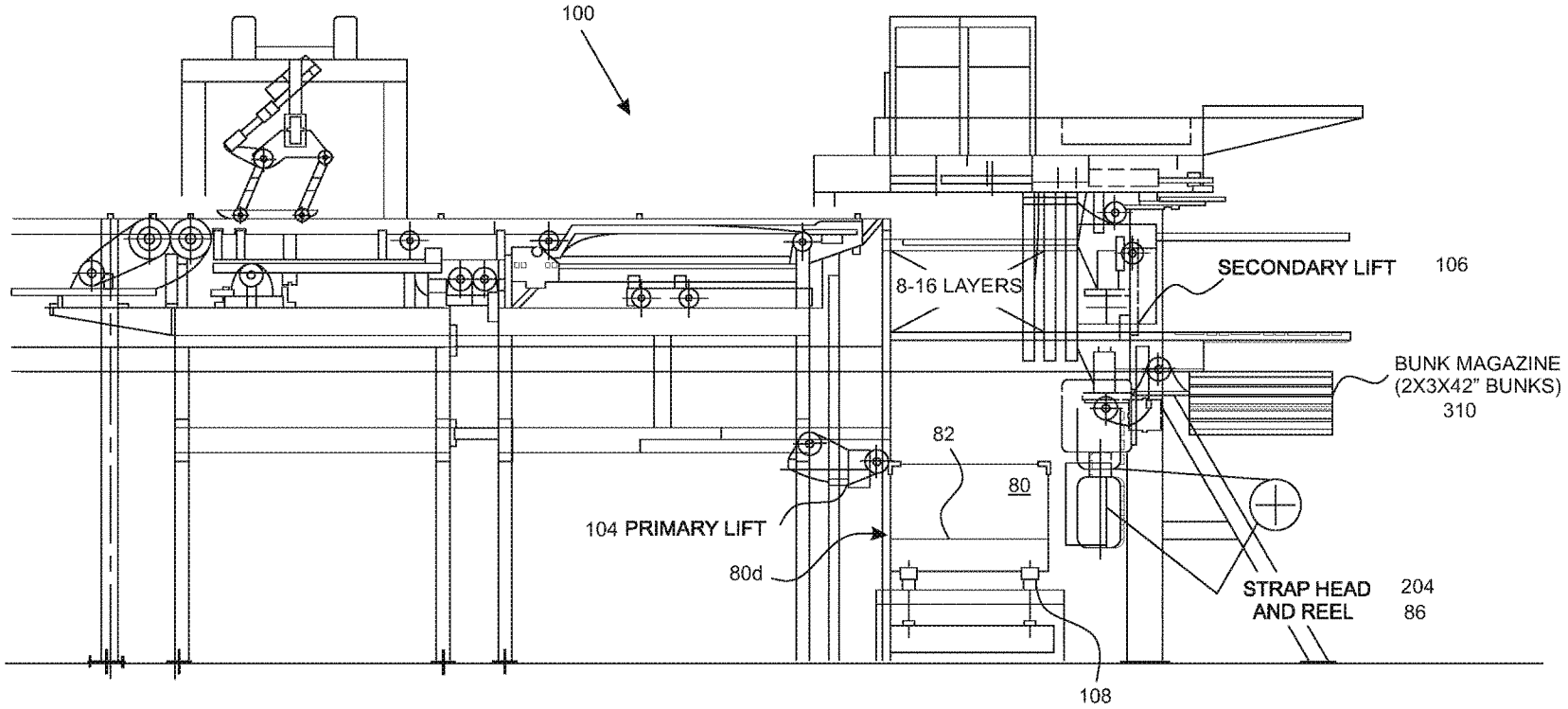
FIG. 3A is a somewhat schematic side elevation view of package accumulation and strapping system of FIG. 1A in a third operating position.

Referring now to FIG. 3, once the finished package 80 is in the down position resting on the bunks/battens 82, the primary lift arms 104 retract. At this point, the bunks 82 are in a raised position on lift skids 220 above corresponding bunk chains 222. A strapping head 204 is positioned to the side of the package, along with side press (or compression) arms 110. The strapping head 204 feeds strap to a strap track 206 with the top strap track lance 208 extended, along with fixed bottom track 211 and far side track 212.

Figure 4:
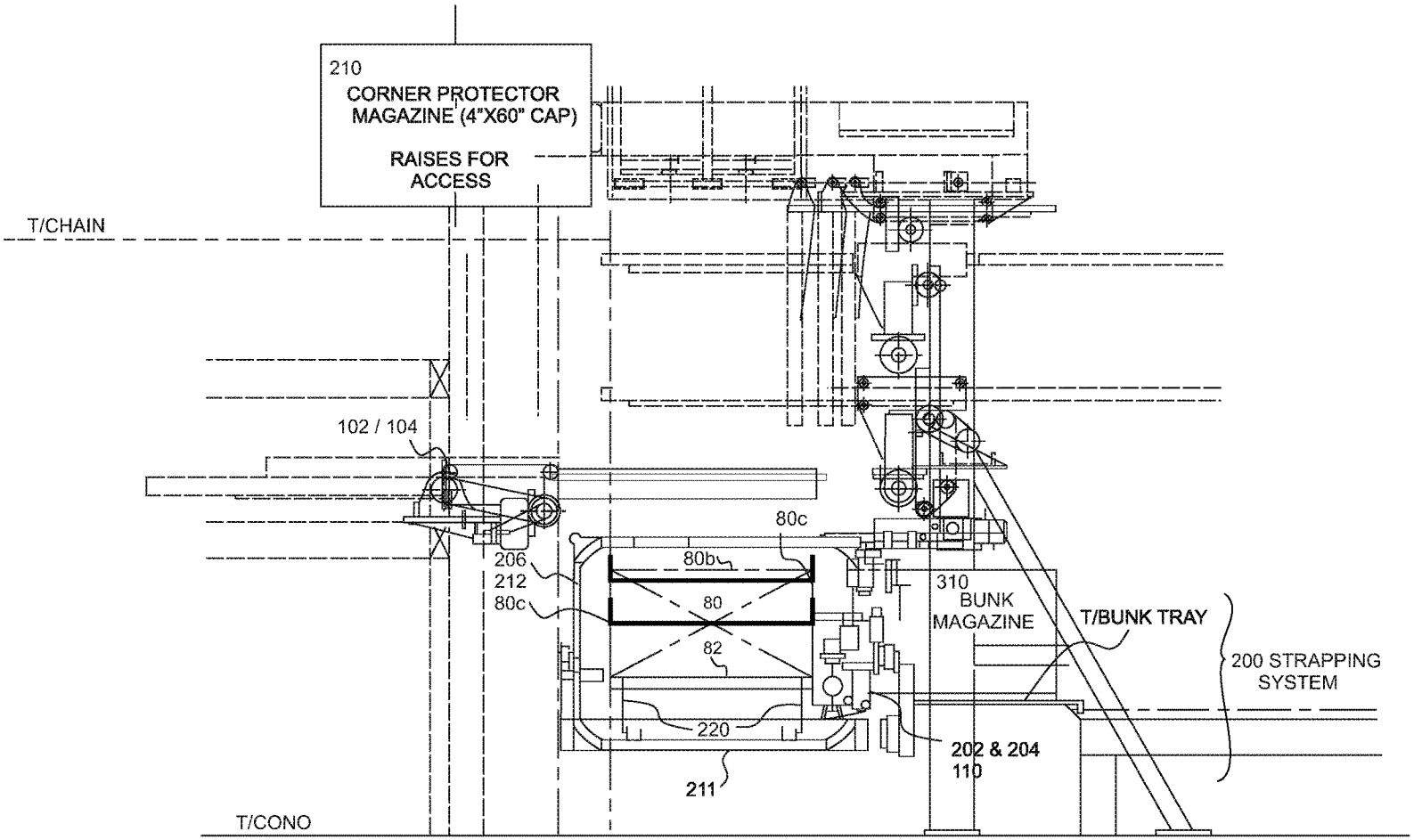
Figure 4A:
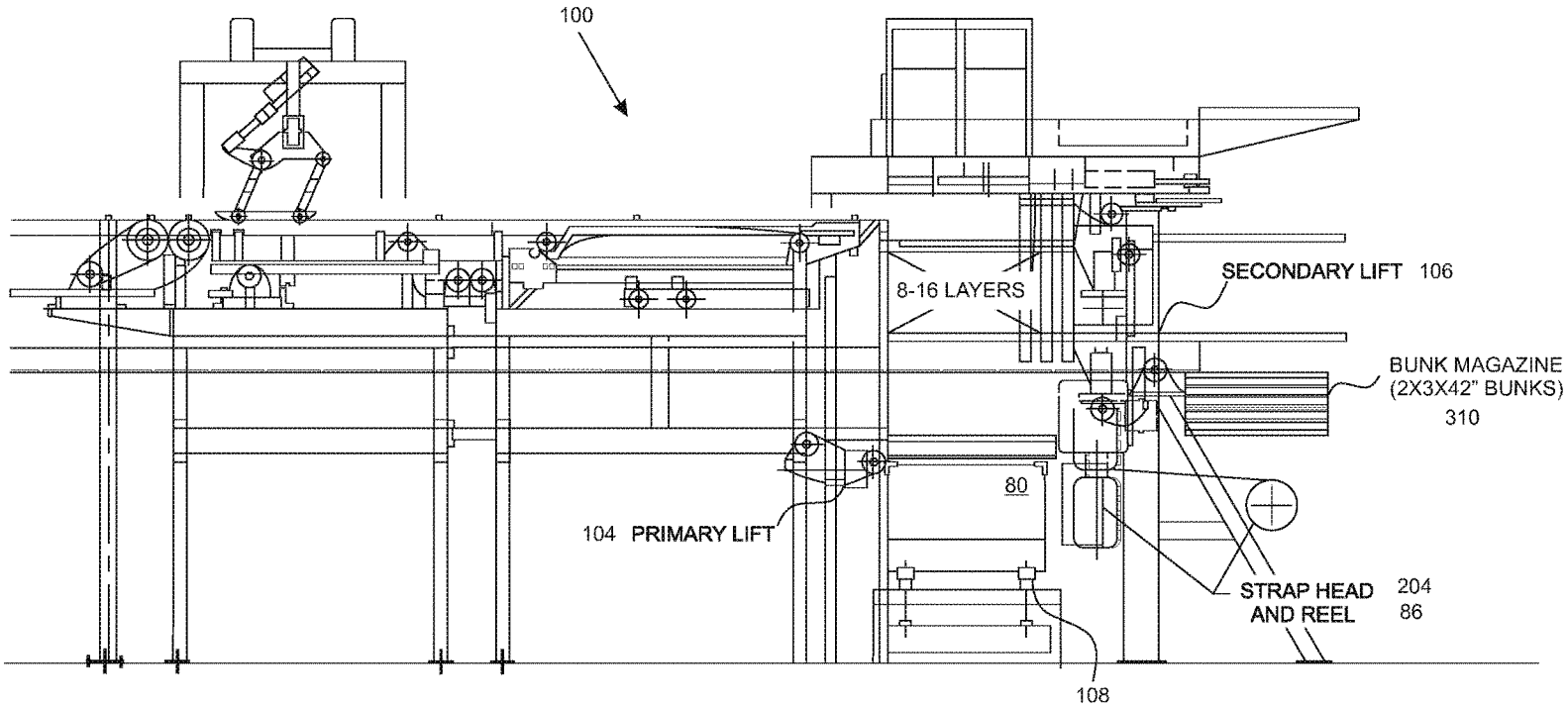
FIG. 4A is a somewhat schematic side elevation view of package accumulation and strapping system of FIG. 1A in a fourth operating position.

Referring to FIG. 4, the retracted primary lift arms 104 raise above the top elevation of the finished package 80 sitting on the bunks 82 and raised lift skids 220, extend out over the package 80 and then compress the top 80*b* of the package 80 in unison with the side compression arms 110 compressing the side 80*c* of the package 80. The primary lift arms 104 can therefore be used to provide top compression arms for the package 80. The side compression arms 110 may also be used to place the sealer/strapping head 204 snug to the side of the package 80. In other embodiments, the strapping heads 204 may be self-propelled to move to and away from the side of the package 80 on their own.

Figure 5:
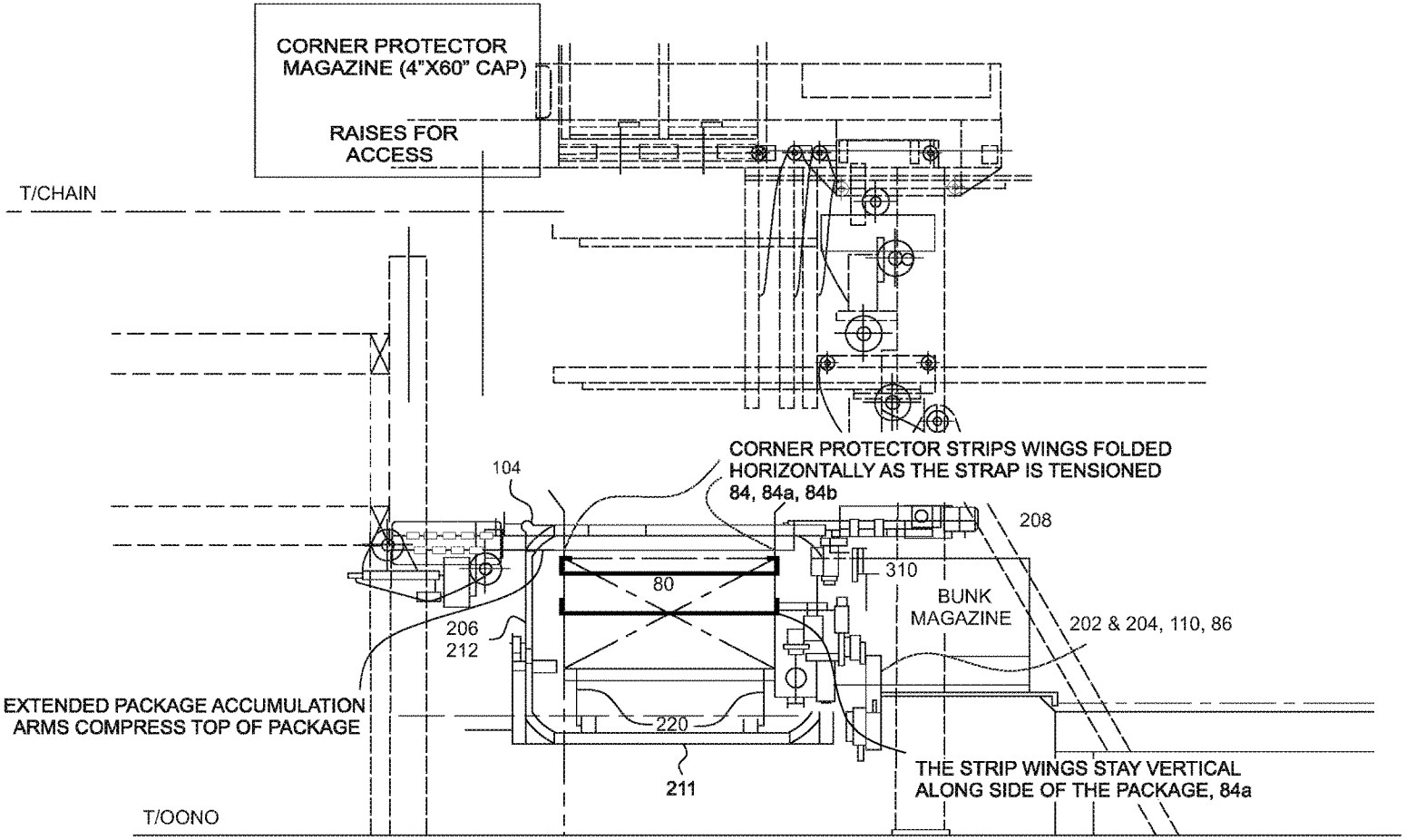
Figure 5A:
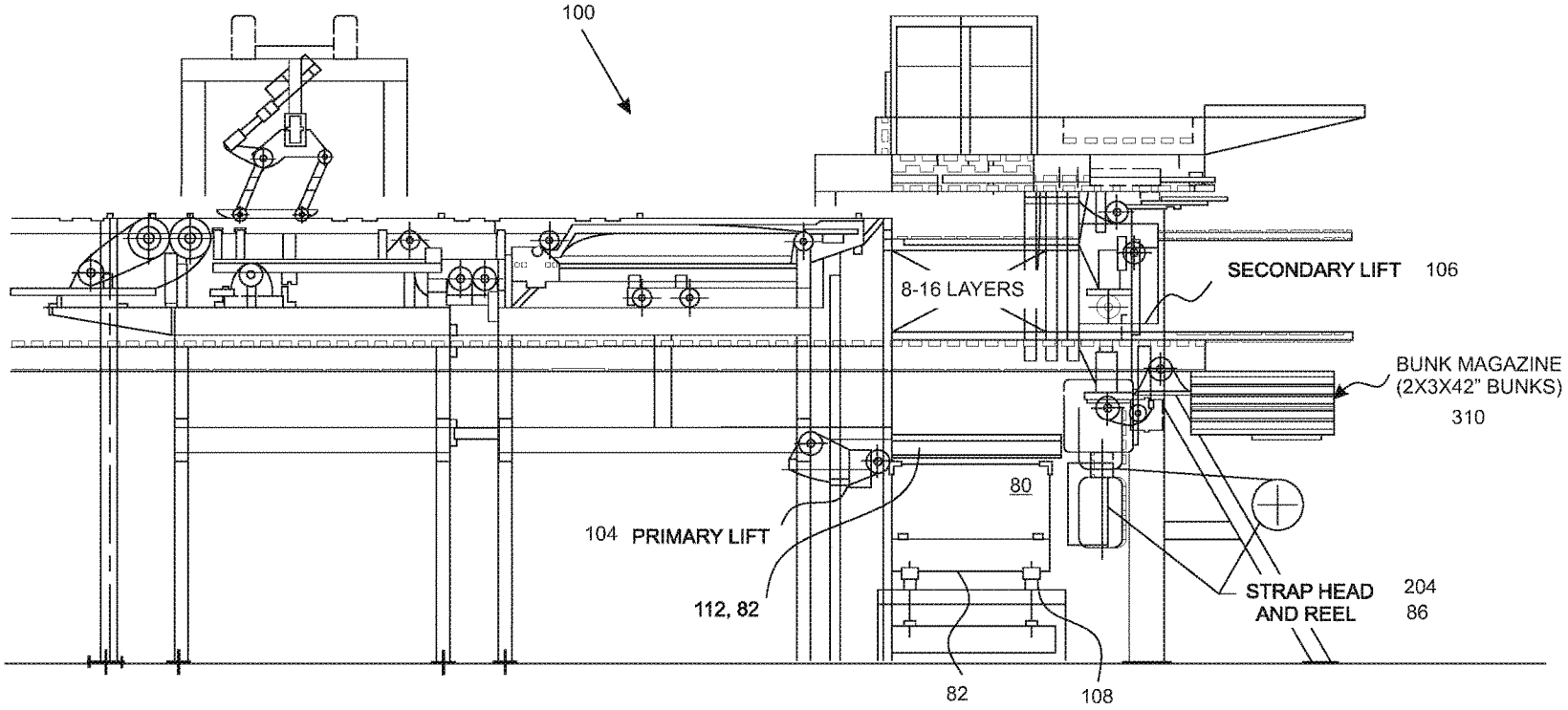
FIG. 5A is a somewhat schematic side elevation view of package accumulation and strapping system of FIG. 1A in a fifth operating position.

Referring to FIG. 5, while the top and side compression arms 104, 110, respectively, compress the stacked lumber into a tight package 80, the strap 86 can be cinched, sealed, and cut in the strap head 204. The vertical wings 84*a* of the corner protection strips 84 are folded horizontally against the top of the package 80*b* as the strap 86 is tensioned, providing the lumber package 80 with top corner protection.

Figure 6:
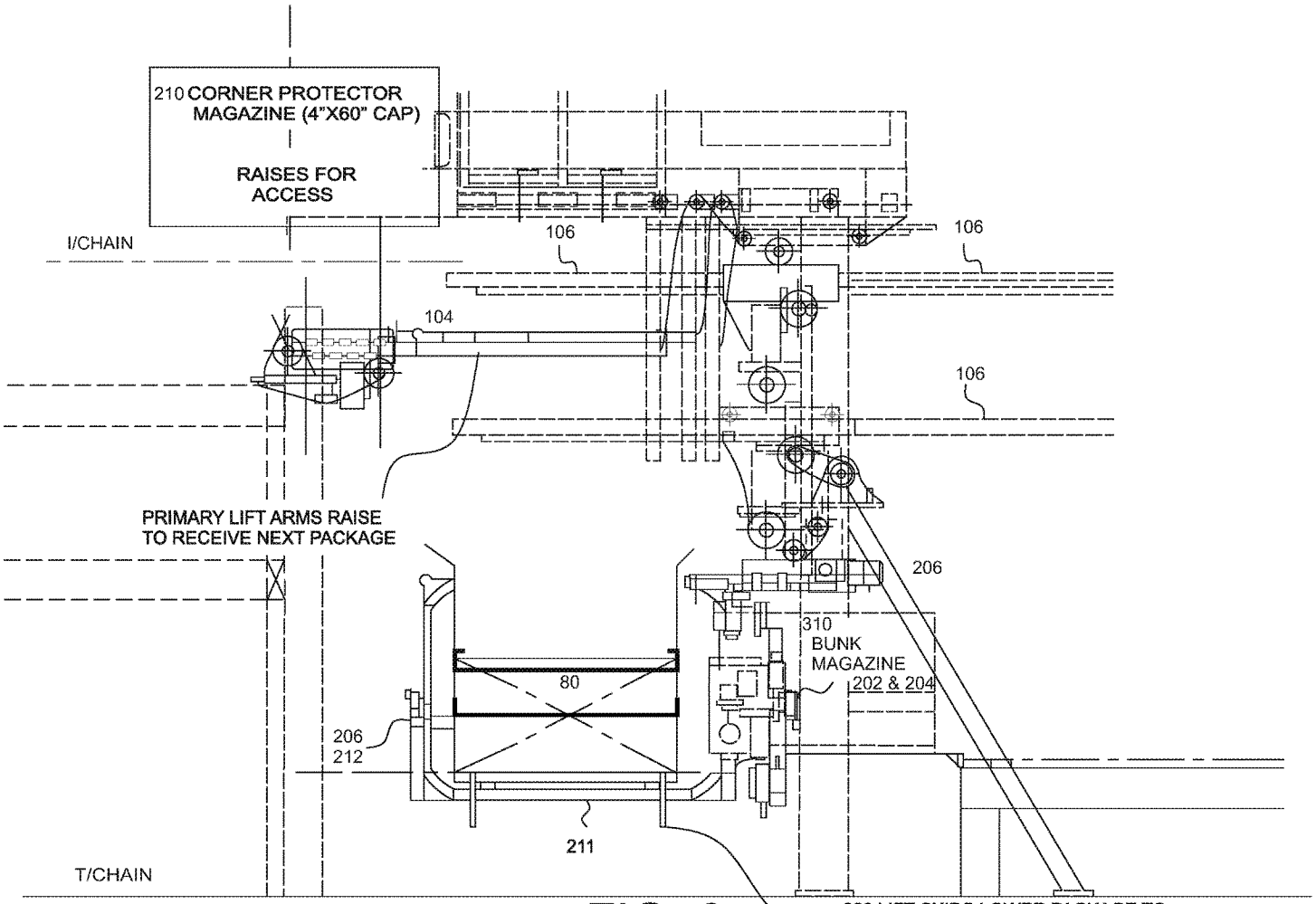
Figure 6A:
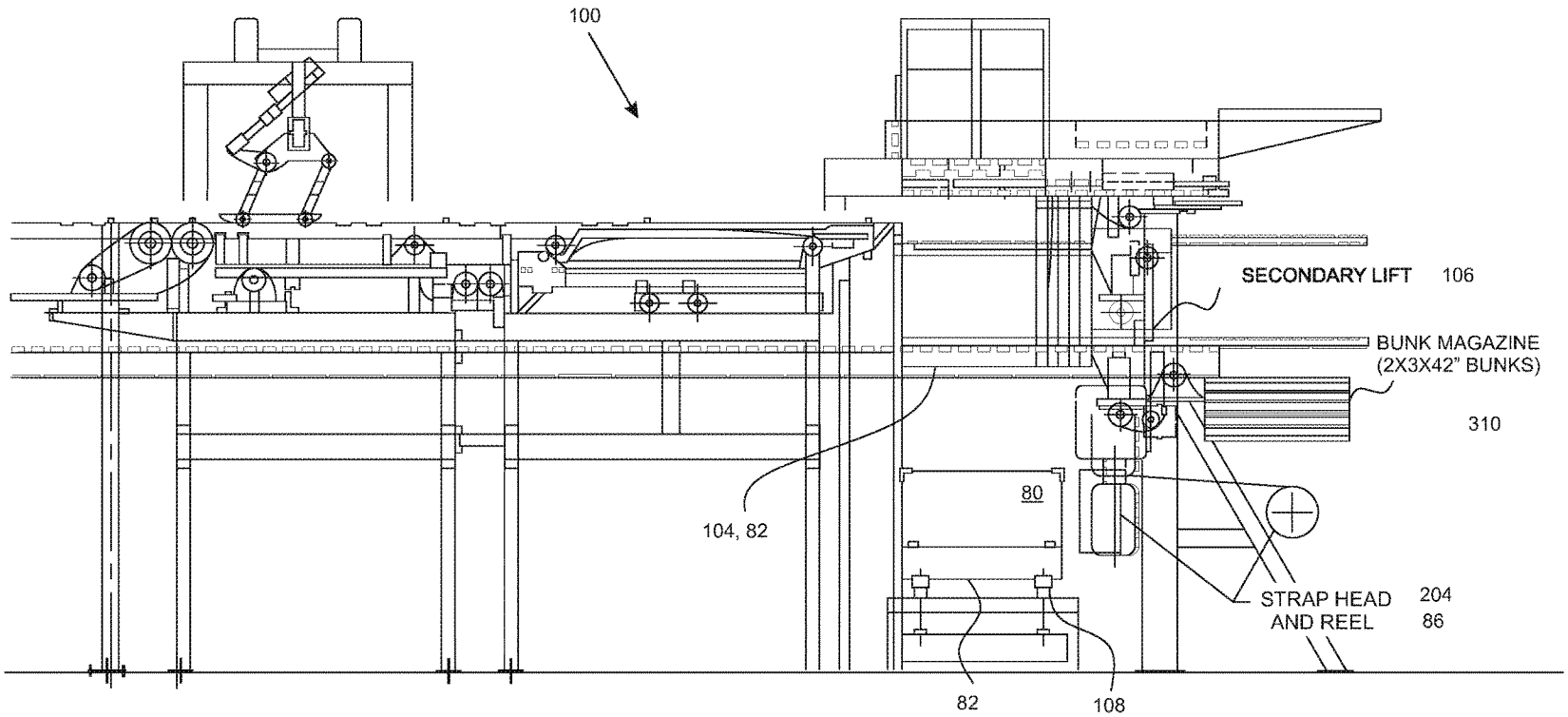

Referring finally to FIG. 6, once the package 80 has been strapped, the lift skids 220 lower the strapped package 80 to the bunk chains 222 and it is discharged. After strapping, the primary lift arms 104 can be raised and retrieve the next package from the secondary lift 106. The retrieved package from the secondary lift 106 is finished out as necessary and lowered to the first sequence position illustrated in FIG. 1 and the process can then be repeated.

FIGS. 1A through 6A illustrate an alternative embodiment of the present inventive concepts. While the overall process of this embodiment may be substantially similar to the process just described, some differences may exist. For instance, these differences may include applying top corner protectors onto fully accumulated packages during a second step in the process. Like elements are referred to using like numerals.

Referring to FIGS. 1A through 6A, the secondary lift 106 accumulates a desired number of layers of material (for instance, 8 or 16 layers of 2" thick lumber). The primary lift 104 retrieves a full or partial package from the secondary lift 106, allowing any partial packages to be completed, and lowers the full package 80 to the outfeed transfer 108. The bottom bunks/battens 82 are already in place, for instance using the method described later with respect to FIGS. 7-12 herein. The secondary lift 106 then moves back into the up and extended position to begin receiving layers of lumber for a subsequent package while the primary lift 104 lowers a full package 80 onto the bunks/battens 82.

The primary lift arms 104 can be retracted once the finished package 80 is in the down position. Top corner protectors 84 may be applied as needed or desired. The strapping head 204 either feeds strap 86 to a strap track device with top and bottom retracting tracks, and fixed far side track, or the primary lift arms 104 may secure the strap 86 from the strap head with a grabber-like device and pull it under the corresponding bunk 82 and/or the package 80 without a bunk.

As one possible method for wrapping the strap 86 around the package 80, the retracted primary lift arms 104 may be raised above the top elevation of the finished package 80 on the outfeed transfer 108 along with the secured strap 86, thereby positioning the strap 86 around the backside 80*d* of the package 80. Of course, there are numerous other methods available to wrap the strap 86 around the package 80 and return it to the strap head 204, any of which are acceptable and contemplated by the present inventive principles.

The primary lift arms 104 may be extended out over the finished package 80 with the secured strap 86 and feed the strap into the strap head 204. Top and side compression arms 104, 110, respectively, may further be activated to compress the package 80 as the strap 86 is being cinched, sealed, and cut in the strap head 204.

To prepare for the next process, bunks 82 may be slid onto the primary lift arms 104, or onto trays 112 mounted elsewhere, before the primary lift arms 104 return to the up position to retrieve the package being accumulated. The primary lift arms 104 are then raised with the bunks 82 in place (or without bunks if no bunks are desired), and retrieve the package 80 from the secondary lift 106 to finish out the package 80 as necessary and then lower the package 80 to the starting position to repeat the process.

Figure 7:
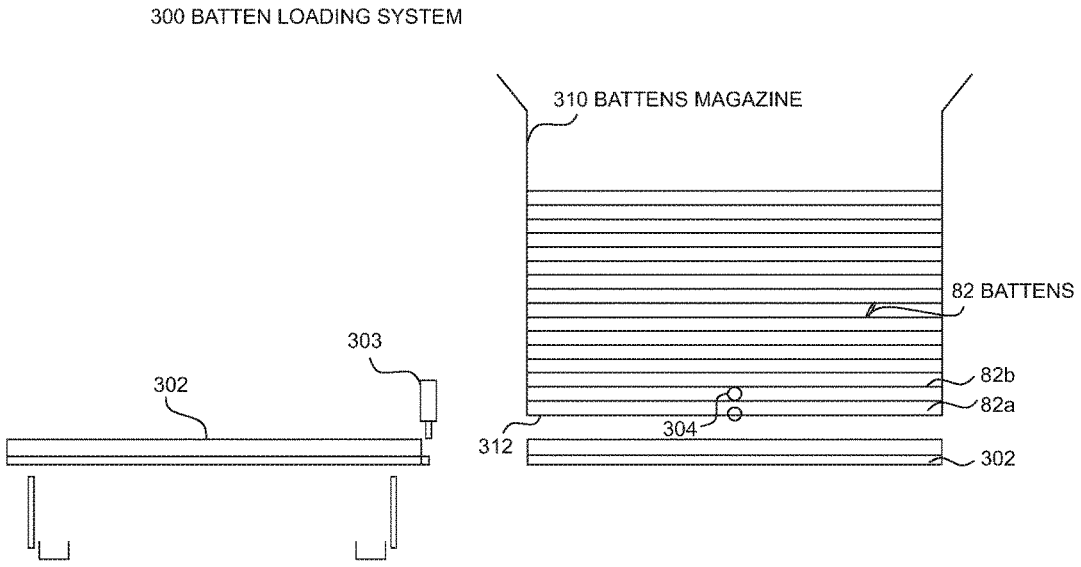
FIG. 7 is a somewhat schematic side elevation view of a batten loading system of a combination package accumulation and strapping system according to further aspects of the present inventive concepts.
Figure 8:
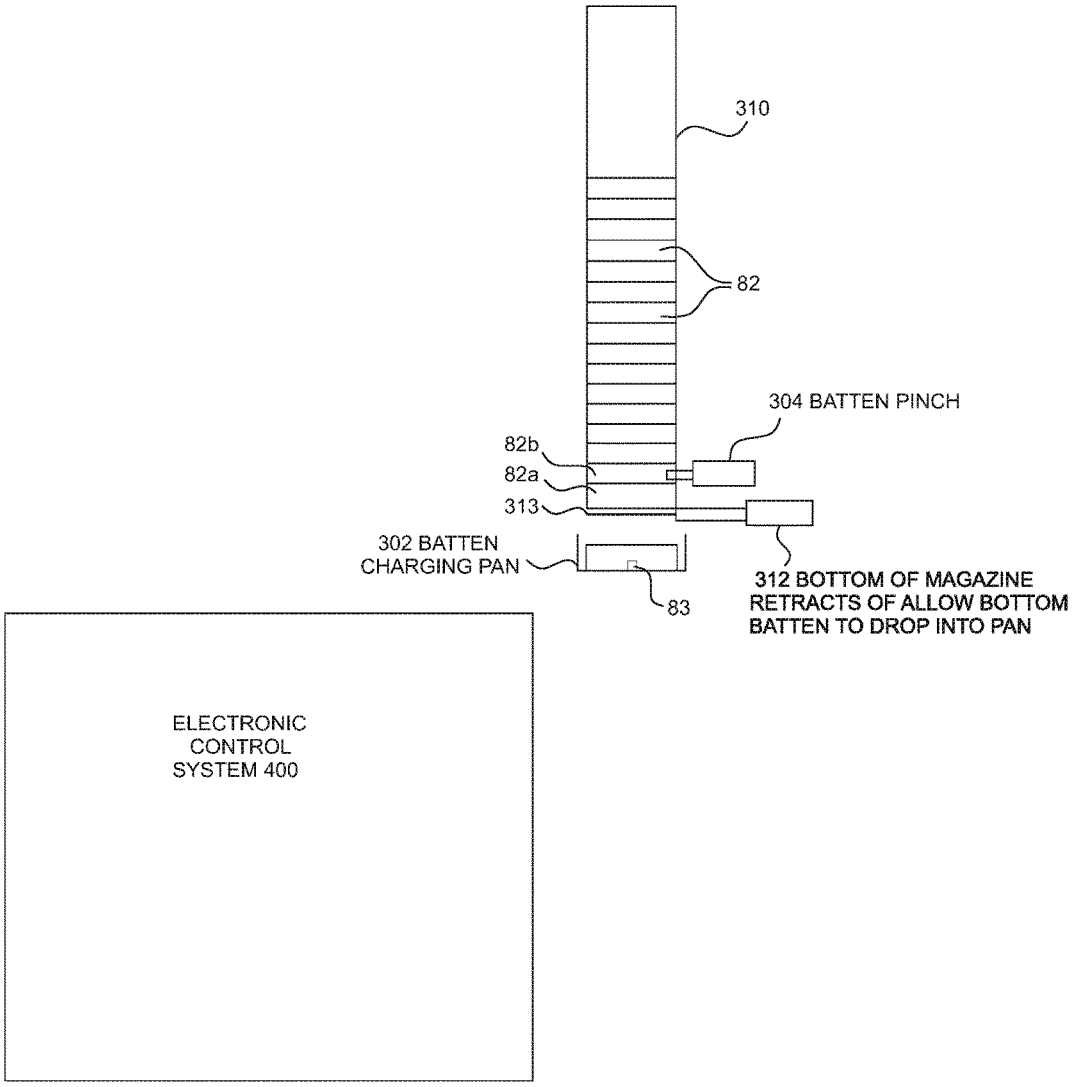
FIG. 8 is a somewhat schematic front elevation view of the batten loading system of FIG. 7.
Figure 9:
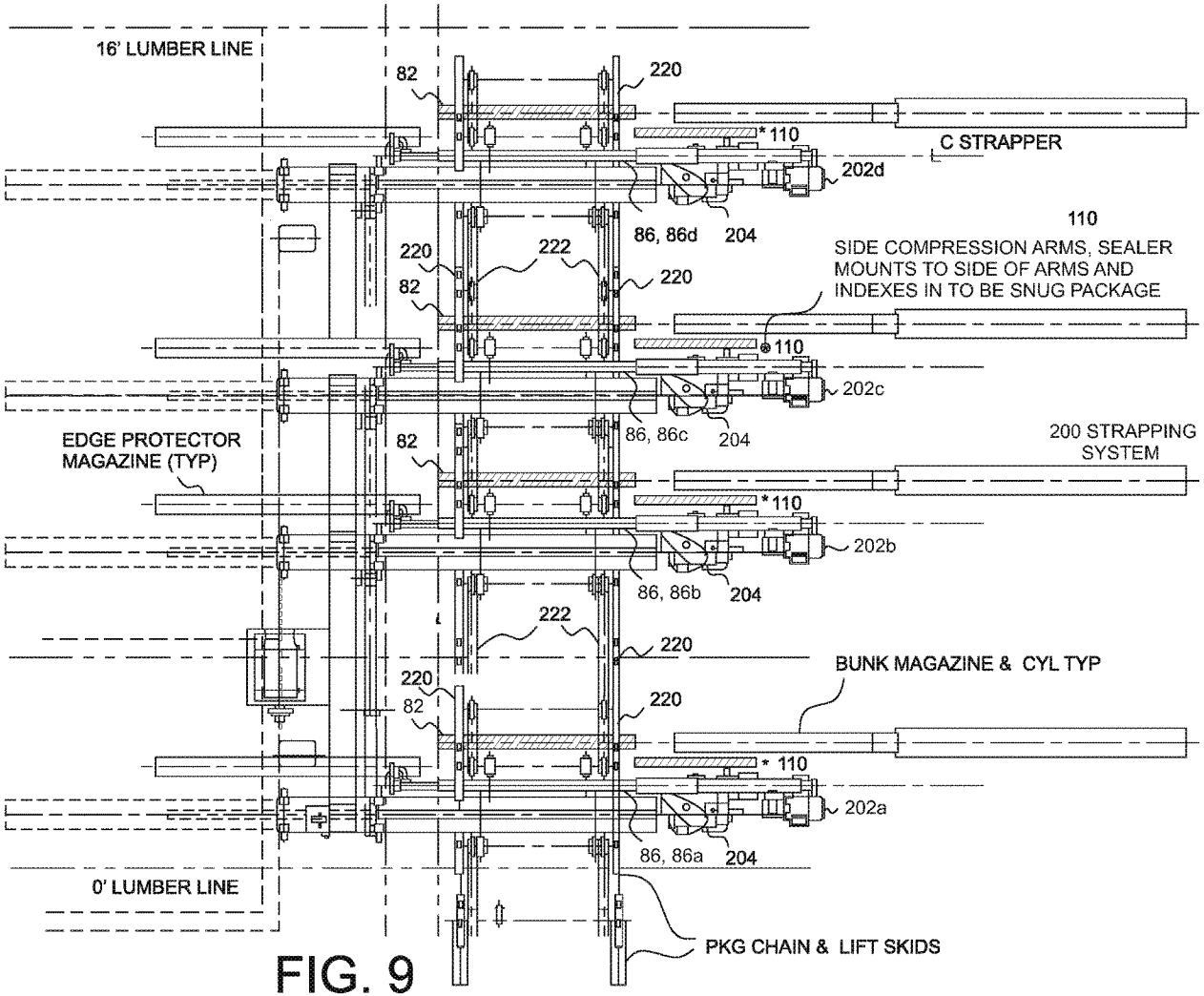
Figure 10:
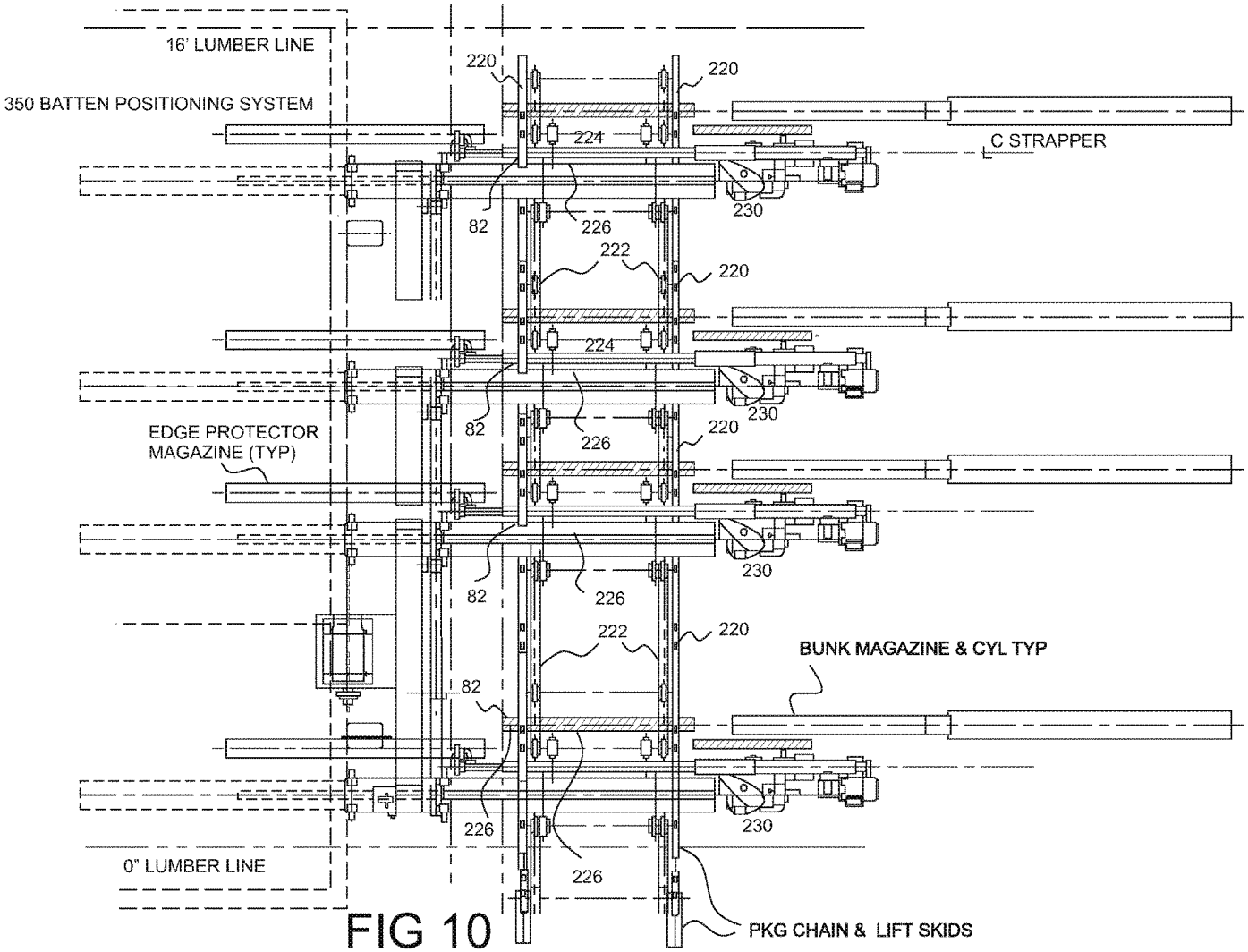
Figure 11:
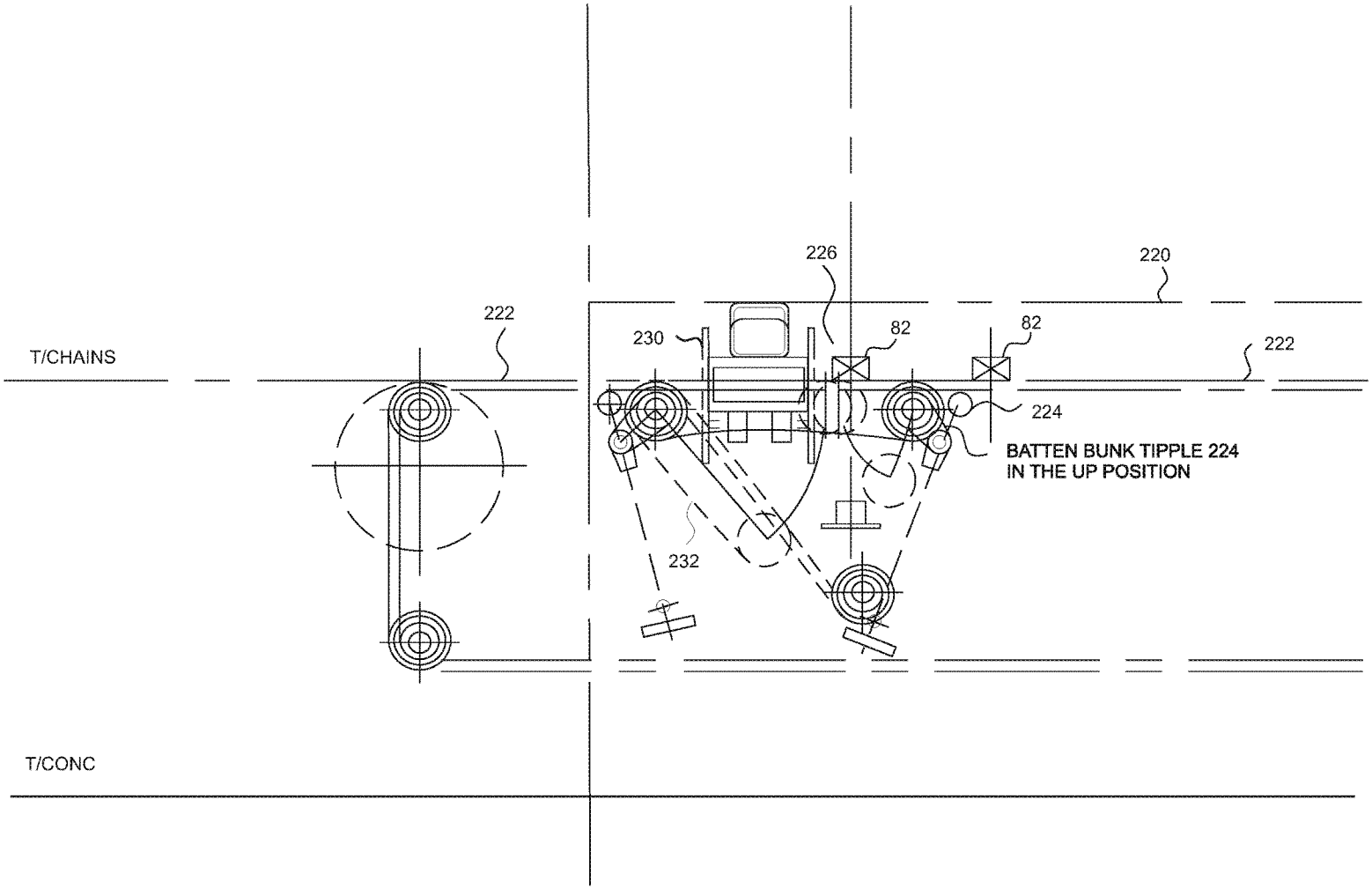
Figure 12:
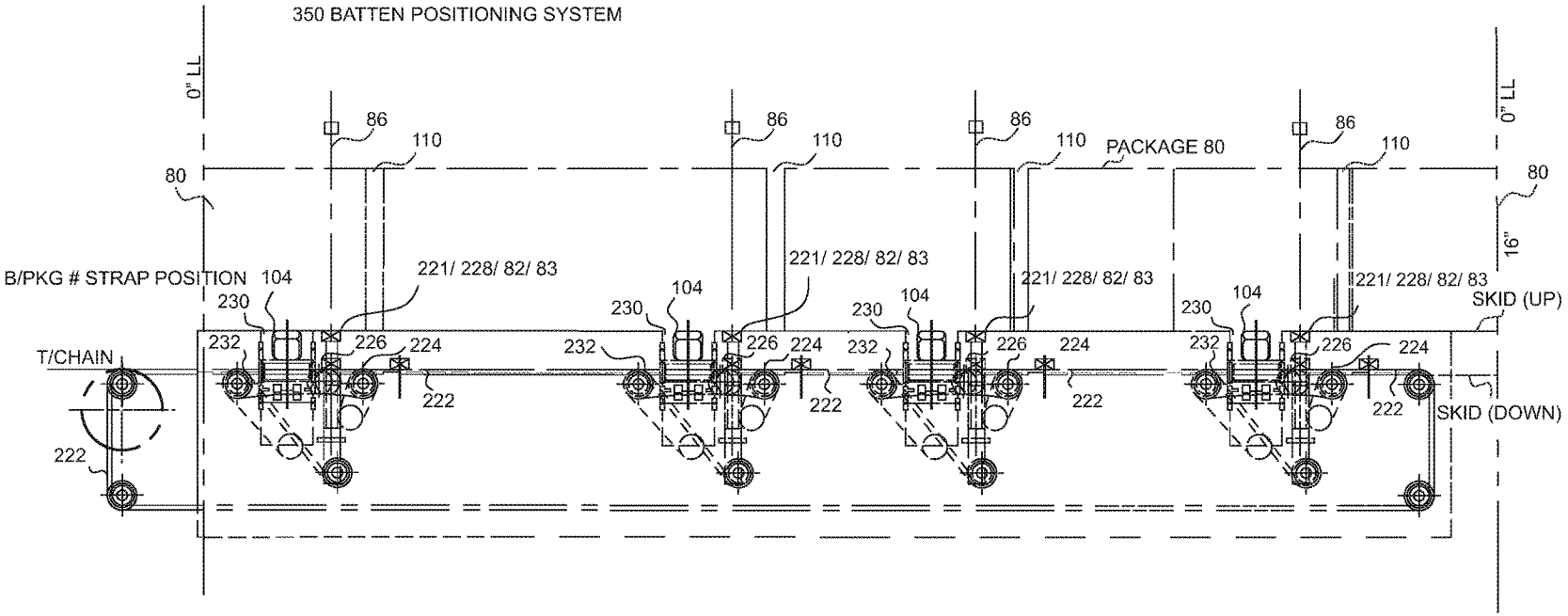

As indicated previously, it may be desirable to attach bunks/battens 82 to the package 80 to accommodate fork lift arms or the like for package transportation, and to further facilitate stacking and storage of packages 80. FIGS. 7 and 8 illustrate a batten loading system 300 according to further aspects of the present inventive concepts. FIGS. 9 through 12 illustrate a batten positioning system 350 and its method of operation in connection with the package accumulation and strapping system 50 described previously, according to still further aspects of the present inventive concepts. Referring now to FIGS. 7 through 12, an operation of the batten loading and positioning systems 300, 350, respectively, in combination with the package accumulation and strapping system 50 will now be explained.

Referring first to FIGS. 7 and 8, a batten loading system 300 may include a batten magazine 310 that is loaded with battens 82. The magazine 310 may include a retractable bottom 312 that retracts to allow a lower first batten 82*a* to drop from the magazine 310 into a batten charging pan 302 at the appropriate time. A batten pinch 304 may be arranged near a batten 82*b* located second from the bottom in the batten magazine 310 to prevent feeding multiple battens 82 into the batten charging pan 302. The retractable bottom 312 and batten pinch 304 may be electronically controlled under control of an electronic control system 400 to efficiently control the timing of the batten loading process.

The batten loading process may begin by manually loading battens 82 into the batten magazine 310. Each batten 82 may, for example, be a 1.5"×2.5"×45" long batten having a 1" wide strap groove 83 formed in the bottom thereof. The stack of battens in the batten magazine 310 may be gravity fed to a charging pan 302 located below the batten magazine 310. The stack of battens in the batten magazine can be held in place by a batten pinch 304 that secures the second to the bottom batten 82*b* in place while the batten feeder opens the retractable bottom 312 to allow the bottom batten 82*a* to pass through a bottom opening 313 in the magazine 310 and load into the charging pan 302.

Referring still to FIGS. 7 and 8 and additionally to FIGS. 9 through 12, a batten positioning system 350 may be used to position the loaded battens 82 below the package 80. After a batten 82 is loaded into the charging pan 302, the charging pan 302 extends out over the batten chains 222 and lowered lift skids 220. A rake off 303 then drops down behind the loaded batten 82 to cause the batten 82 to slide off the charging pan 302 onto the batten chains 222 as the charging pan 302 is retracted. The batten 82 can then be positioned to receive a package 80 thereon, and the charging pan 302 is moved back into place to receive another batten 82.

After battens 82 are loaded onto the batten chains 222 at their desired positions by the batten loading system 300, the battens 82 are then crowded by running the batten chains 222 and the batten tipple 224 until the battens 82 hit the stops 226 located by the strap lines. The batten tipple 224 is then in the up position.

The lift skids 220 are raised with the battens 82 in the lift skid cradles 228 and are ready to receive a finished package 80 from the package accumulation hoist arms 104. The package 80 is then lowered onto the battens 82 within the lift skid cradles 228, and the package accumulation arms 104 continue down into the package accumulation arm lift skid slots 230 until they are clear of the bottom of the package 80. The package arm tipples 232 are moved to the lower position to allow clearance for the package accumulation arms 104 to retract out from under the package 80.

Once clear to retract, the package accumulation arms 104 can then be retracted and cycle up and then over the assembled package 80 with the strap track to top compress the package 80 while it is being strapped, as explained previously. The side compression arms 110 can work in unison with the top compression arms 104 and the strap sealer/strapping head 204, bringing the strap 86 snug with the side of the tightly formed package 80. In this manner, a strap 86 can be wrapped around each of the battens 82 and fit snugly within the strap groove 83 on the bottom of the batten 82 when the strap 86 is tightened and sealed. The side compression arms 110 and strapper head 204 could be integral with one another, or the strapper head 204 could be independently arranged.

The lift skids 220 remain in the up position, cradling the battens 82 while the package 80 is being strapped. Once the package 80 is strapped, the batten and package arm tipples 224, 232, respectively, are both raised to the horizontal position to receive the package 80 strapped to the battens 82 and then discharge the strapped package 80 using the tipples 224, 232 and batten chains 222.

Alternatively, the battens 82 may be placed directly into batten saddles 221 on the raised lift skids 220 using bunk/batten applicators 330. The bunk/batten applicators 330 may, for instance, be arranged on the same carriages as the side-shiftable strappers 202. The bunk applicator 330 could be configured to place a bunk 82 into the saddle 221 on the raised lift skid 220. The strapper 202 could then be shifted over the bunk 82 to apply the strap 86. This system could prove more efficient than crowding bunks to stops.

Having described and illustrated principles of the present invention in various preferred embodiments thereof, it should be apparent that the invention can be modified in arrangement and detail without departing from such principles.

What is claimed is:

1. A single-station package accumulation and strapping system, comprising:

a package accumulator for accumulating material into packages, wherein the package accumulator gathers and organizes the material into an accumulated package comprising a plurality of flat layers, and wherein the accumulated package is delivered directly from the accumulator to a package strapping system using a lift to lower the package into the package strapping system;

wherein the package strapping system comprises a package compression and strapping station comprising compression arms configured to compress the accumulated package and multiple strappers configured to strap the package; and the package strapping system arranged in a location proximal to the package accumulator and configured to receive the accumulated package as an integral unit directly from the package accumulator, and wherein the package strapping system is further configured to strap the accumulated package together into an assembled package at the location.

2. The package accumulation and strapping system according to claim 1, wherein the package strapping system is further configured to simultaneously strap the accumulated package at three or more positions along a length of the accumulated package.

3. The package accumulation and strapping system according to claim 1, wherein the compression arms are configured to help formulate the package as it is being accumulated and then top compress the package as it is being strapped.

4. The package accumulation and strapping system according to claim 1, wherein the compression arms comprise one or more side compression arms configured to side compress the accumulated package into a tight bundle.

5. The package accumulation and strapping system according to claim 4, wherein the side compression arms are adjustable to accommodate and compress accumulated packages of various widths.

6. The package accumulation and strapping system according to claim 1, wherein the compression arms comprise one or more top compression arms configured to top compress the accumulated package into a tight bundle, and wherein the top compression arms are capable of compressing accumulated packages of various package heights.

7. The package accumulation and strapping system according to claim 1, further comprising a bunk application system configured to supply one or more bunks to the accumulated package before the package is strapped.

8. The package accumulation and strapping system according to claim 1, wherein the package accumulator includes a package accumulation hoist configured to lower an accumulated package directly into the package compression and strapping station of the package strapping system.

9. The package accumulation and strapping system according to claim 1, wherein the package accumulator comprises a plurality of package accumulation arms configured to accumulate material into packages and wherein one or more of the plurality of package accumulation arms are configured to operate as the compression arms of the package strapping system for top compressing an accumulated package in the package strapping system.

10. The package accumulation and strapping system according to claim 1, further comprising a corner protector strip applicator configured to supply corner protector strips to the package underneath a top layer of the accumulated package in alignment with strapping lines where the accumulated package is to be strapped.

11. A single-station package accumulation and strapping system, comprising:

a package accumulator for accumulating material into packages, wherein the package accumulator gathers and organizes the material into an accumulated package comprising a plurality of flat layers, and wherein the accumulated package is delivered directly from the accumulator to a package strapping system using a lift to lower the package into the package strapping system, wherein the package accumulator includes a package accumulation hoist configured to lower an accumulated package directly into a compression and strapping station of the package strapping system; and the package strapping system arranged in a location proximal to the package accumulator and configured to receive the accumulated package as an integral unit directly from the package accumulator, and wherein the package strapping system is further configured to strap the accumulated package together into an assembled package at the location.

12. The single-station package accumulation and strapping system according to claim 11, further comprising compression arms configured to help formulate the package as it is being accumulated and then top compress the package as it is being strapped.

13. The single-station package accumulation and strapping system according to claim 11 further comprising a plurality of strappers, wherein one or more of the plurality of strappers has a lengthwise position that is adjustable to apply a strap at any of multiple desired locations along the length of the accumulated package.

14. The single-station package accumulation and strapping system according to claim 11, wherein the package strapping system is arranged at approximately a same location as a stacker and is configured to accumulate the package directly from the stacker.

15. The single-station package accumulation and strapping system according to claim 11, further comprising a corner protector strip applicator configured to supply corner protector strips to the package underneath a top layer of the accumulated package in alignment with strapping lines where the accumulated package is to be strapped.

16. A single-station package accumulation and strapping system, comprising:

a package accumulator for accumulating material into packages, wherein the package accumulator gathers and organizes the material into an accumulated package comprising a plurality of flat layers, and wherein the accumulated package is delivered directly from the accumulator to a package strapping system using a lift to lower the package into the package strapping system; and a corner protector strip applicator configured to supply corner protector strips to the package underneath a top layer of the accumulated package in alignment with strapping lines where the accumulated package is to be strapped;

wherein the package strapping system is arranged in a location proximal to the package accumulator and configured to receive the accumulated package as an integral unit directly from the package accumulator, and wherein the package strapping system is further configured to strap the accumulated package together into an assembled package at the location.

17. The single-station package accumulation and strapping system according to claim 16, wherein the package accumulator is configured to accumulate material into the package using a secondary lift, and wherein a primary lift of the package accumulator is configured to retrieve the package from the secondary lift, and wherein the package strapping system is configured to receive the package directly from the primary lift of the package accumulator.

18. The single-station package accumulation and strapping system of claim 17, wherein the primary lift is configured to lower the package directly into the package strapping system.

19. The single-station package accumulation and strapping system of claim 17, wherein the package strapping system comprises a plurality of strapping heads, wherein at least one of the strapping heads is moveable along a length of the package, and wherein the package strapping system is configured to simultaneously strap the package at multiple desired locations along the length of the package.

20. The single-station package accumulation and strapping system of claim 19, wherein the plurality of strapping heads comprise three or more strapping heads, and wherein at least two of the strapping heads are moveable along a length of the package.

* * * * *